United States Patent [19]

Breslow

[11] 3,989,249

[45] Nov. 2, 1976

[54] GAME APPARATUS

[75] Inventor: Jeffrey D. Breslow, Highland Park, Ill.

[73] Assignee: Marvin Glass & Associates, Chicago, Ill.

[22] Filed: May 8, 1975

[21] Appl. No.: 575,792

[52] U.S. Cl. ..... 273/87 R; 273/87 F; 273/120 R; 273/134 CG

[51] Int. Cl.[2] ..... A63F 7/06; A63F 7/10; A63F 7/14

[58] Field of Search ..... 273/87, 120, 134 C, 273/134 CG, 121 R

[56] References Cited

UNITED STATES PATENTS

| | | | |
|---|---|---|---|
| 603,738 | 5/1898 | Redgrave | 273/121 R |
| 774,107 | 11/1904 | Peckweg | 273/120 R |
| 1,597,457 | 8/1926 | Moorman | 273/87 F X |
| 2,230,834 | 2/1941 | Gilmore | 273/134 CG |
| 3,712,620 | 1/1973 | Goldfarb et al. | 273/120 R |
| 3,884,469 | 5/1975 | Morton | 273/120 R X |

*Primary Examiner*—Paul E. Shapiro

*Attorney, Agent, or Firm*—Coffee & Sweeney

[57] ABSTRACT

A golf game including a play board in the form of a putting green, and two sets of playing cards for determining the order in which players of the game arrive at the green and the distance and position each player's ball lies relative to a pin. One set of playing cards is representative of the different holes on a golf course, each card having a diagram of a particular hole including possible positions of players' shots, along with a number of hazards such as sandtraps, streams and trees. The other set of playing cards includes indicia representative of the length of the various players' shots. One hazard reference card also is provided having indicia thereon dictating the consequences which may befall a player whose shot lands in a particular hazard. The putting green includes a generally concave surface which slopes downwardly towards a hole, and includes yardage markings which permit a player to attempt to roll a ball into the hole. A die is provided to determine the consequences of a player landing in a particular hazard, in accordance with the instructions on the hazard reference card.

9 Claims, 5 Drawing Figures

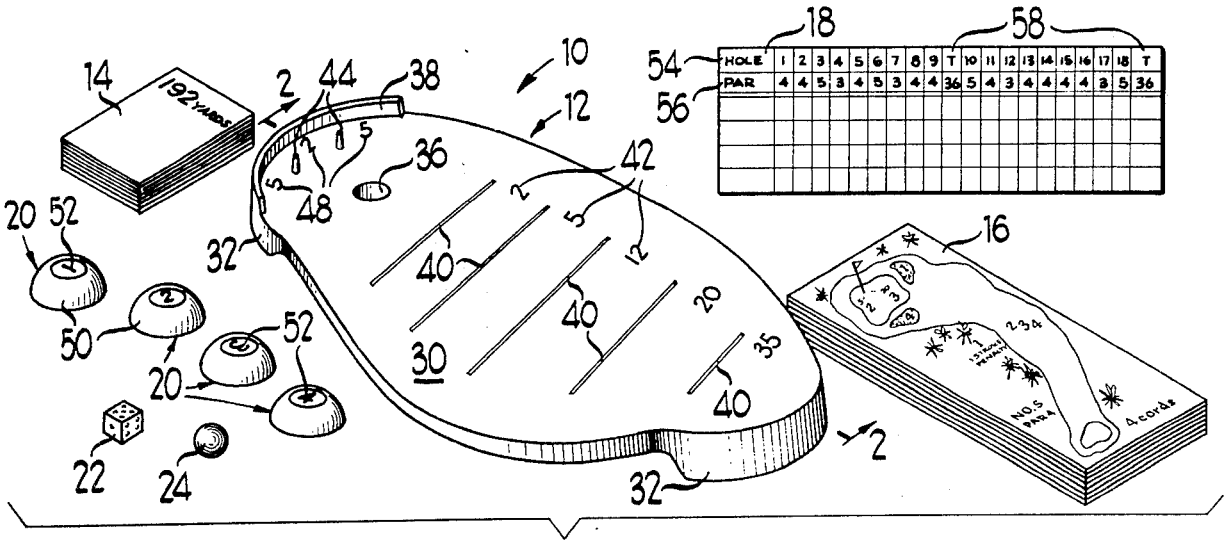
Fig 1
Fig 2
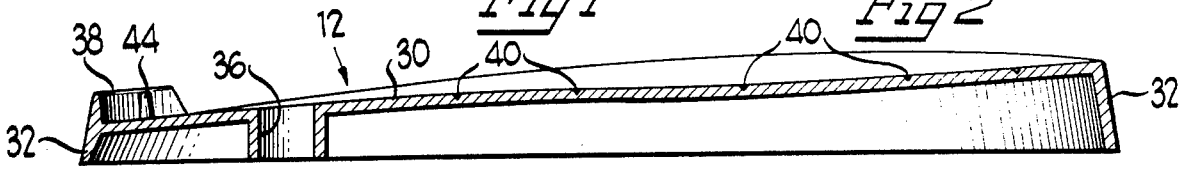
Fig 3
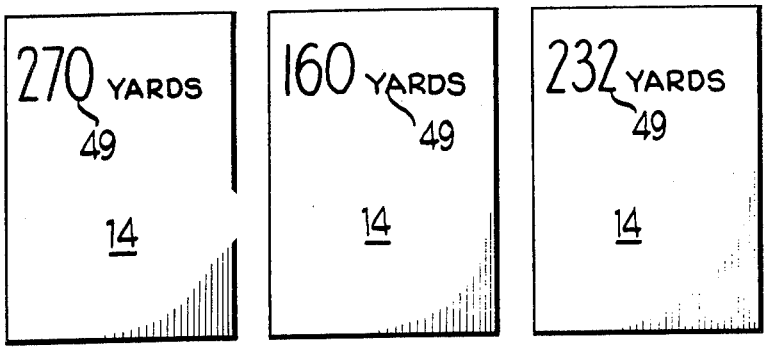
Fig 4
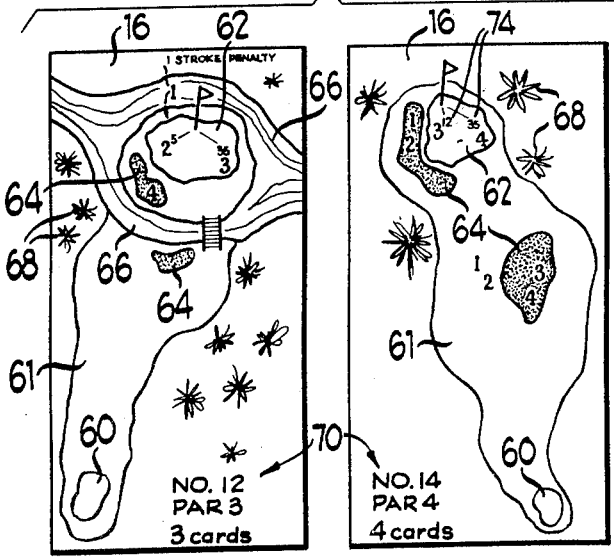
Fig 5
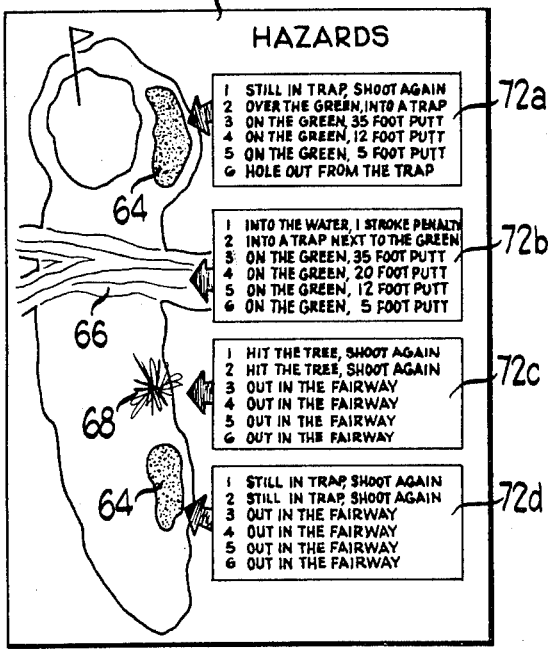

GAME APPARATUS

BACKGROUND OF THE INVENTION

1. Field of the Invention

This invention relates to a game apparatus, and more particularly to a golf game which is played with a simulated green, sets of cards and a chance device.

2. Description of the Prior Art

Over the years, a variety of simulated golf games have been devised. In general, such games include a gameboard showing the layout of one or more golf holes and means for generating the yardage attained on a given shot which usually employs a type of chance device.

Such prior proposals have a number of deficiencies. For example, some require the use of a plotting device to be used in connection with the gameboard to determine the position of advancement of each player on a hole. Others employ mechanical yardage generating devices which are complicated and bulky and often difficult for children to use. Still others have used a set of dice for generating the yardage of a particular shot, but these are limited by the number of yardage increments attained from the chances of the dice, thereby detracting from the realism of the game as contrasted to the actual game played outdoors.

SUMMARY OF THE INVENTION

It is an object of the present invention to provide a new and improved simulated golf game apparatus of the type employing a plurality of sets of playing cards and a chance device to provide an element of chance for the game.

The exemplary embodiment of the present invention also includes a playboard simulating a putting green having yard markings thereon which permit the players of the game to realistically attempt to putt a ball into a hole provided at one end of the green by rolling a ball along the board toward the hole. Two sets of playing cards are provided to enable the players to determine how many shots were required for them to reach the green and their distance from the hole on the green. One set of playing cards includes a number of hole cards, typically 18, each having a diagram representative of a different hole on a golf course including various hazards. The second set of playing cards includes indicia thereon representative of the number of yards which a ball has travelled on a particular shot by a player and are selectively usable by the players at the various holes. The game also includes at least one hazard reference card which has indicia to determine the consequences which will befall a player should his shot or ball land in a sandtrap, stream or hit a tree, in accordance with the roll of a die.

BRIEF DESCRIPTION OF THE DRAWINGS

FIG. 1 is a perspective view of the elements of the golf game apparatus embodying the concepts of the present invention;

FIG. 2 is a vertical section, on an enlarged scale, of the putting green, taken generally along line 2—2 of FIG. 1;

FIG. 3 is a plan view, on an enlarged scale, of three of the distance or yardage cards used by the players during play of the game of the present invention;

FIG. 4 is a plan view, on an enlarged scale, of two of the hole cards of the present invention; and FIG. 5 is a plan view of the hazard reference card of the present invention.

DESCRIPTION OF THE PREFERRED EMBODIMENT

An exemplary embodiment of the golf game apparatus in accordance with the concepts of the present invention is illustrated in FIG. 1, generally designated 10. The golf game 10 includes a playboard, generally designated 12, defining a simulated putting green, a set of distance or yardage cards 14, a set of hole cards 16, a score card 18, a set of player sequence markers, generally designated 20, a die 22, a putting ball 24, and a hazard reference card 26 (FIG. 5).

The putting green 12 includes a top surface 30 which is supported on a table or other suitable surface by a depending peripheral flange 32. The surface 30 is concave in cross section and slopes downwardly in a longitudinal direction towards a hole 36 so that as a player attempts to "putt," he will attempt to roll the ball 24 down the surface and to drop the ball into the hole 36. The hole 36 is open at the bottom so that the ball may be retrieved by simply lifting the putting green 12. The surface 30 continues to slope downwardly past the hole 36 to its lowermost end where a ball 24 which misses the hole will be stopped by a generally upstanding arcuate flange 38. Additionally, the surface 30 includes a plurality of transverse notches 40 and indicia 42 adjacent one of the notches 40 to indicate that that notch represents a particular distance from the hole 36. As shown, five notches are provided with indicia of "2," "5," "12," "20" and "35" feet from the hole. The lowermost side of the surface 30, in front of the arcuate flange 38, is divided into three areas by a pair of upstanding pins 44 so that if a putt misses the hole 36, the ball 24 will land in one of the areas between the posts 44. These areas include indicia 48 (5, 2 and 5) representative of the distance in feet from the hole, from which the player's next attempt to putt will have to be made. The player will then continue to attempt to putt untill he successfully drops the ball into the hole, each attempt being scored as a stroke.

Referring to FIG. 3, the set of playing cards 14 each include indicia 49 thereon representative of a particular number of yards which a player's ball has travelled on a shot. The indicia ranges from 160 yards up to 270 yards, for instance, preferably with the indicia on no two cards being identical.

The player sequence markers 20 are in the shape of a shell or hemisphere 50 having indicia 52 on the top thereof ranging from 1 to 4, to be given to four players of the game in order to designate their position or sequence for the next shot.

The score card 18 is similar to a typical golf score card having a horizontal column 54 representing the hole number and another horizontal column 56 representing the par for that particular hole. Vertical columns are provided to record the score of each player and a totalling column 58 is provided at the end of nine holes and 18 holes to permit the players to total their scores.

The hole cards 16, represented in FIG. 4, each include a diagram representative of a schematic or map of a particular hole. The hole cards 16 each include a tee 60, a fairway 61, a green 62, and one or more hazards in the form of sandtraps 64, streams 66 or trees 68. Additional indicia, generally designated 70, on the card indicates the hole number, the par and the number of distance cards 14 given to each player at the beginning of that hole.

Referring to FIG. 5, the hazard reference card 26 is provided to inform the players of the consequence should their shot hit or land in one of the hazards 64, 66 or 68. The particular consequence is determined by indicia 72*a*–72*d* associated with each hazard 64, 66, or 68 which is represented by a typical hole on the hazard reference card. The particular consequence is determined by a roll of the die 22 as determined by the number shown on the die after a roll, in reference to the numbered consequences "1" through "6" at each of the hazards on the hazard reference card 26. For example, referring to the hole card 16 to the right of FIG. 4, a player whose ball lands in a trap 64 in the fairway 61, players "3" and "4" use the indicia 72*d* to determine the penalty by rolling the die 22. For example, if a player rolls a 3, 4, 5 or 6, he is out on the fairway and is penalized one stroke. If, however, he rolls a 1 or 2, he is still in the trap and must roll the die again thus being penalized at least two strokes and maybe more until he successfully gets out onto the fairway. Another hole card 16, such as the card to the lefthand card in FIG. 4, would indicate which players' first stroke hit a tree, and, as shown, players "3" and "4" would similarly use the indicia 72*c* on the hazard reference card 26 and the roll of the die to determine the consequences of hitting the tree. The same is true for the stream hazards (indicia 72*b* on card 26).

In one scheme of play of the game, the hole cards 16 are used one at a time for playing that hole by all of the players simultaneously. For example, hole 14, represented by the card in the right of FIG. 4, shows a par 4 hole. Each player is given four of the distance cards 14 to use. The player may look at all of his cards 14 while hiding them from the other players of the game. Starting with one player, determined by chance or the like, the players sequentially play or lay down one of their distance cards. The player who has laid down the card 14 showing the highest yardage is designated as number One and so on to the player having the lowest yardage who is designated as number Four. As noted before, players One and Two are on the fairway, while players Three and Four are in the trap and must roll the die according to the hazard card 26 in an attempt to get back out onto the fairway. Thus, by watching the play of the distance cards 14, a player may attempt to determine his position by playing a particular card after he has seen cards played by the previous players. Of course, this advantage depends upon which player is first to lay down his card and will change during the play of the game as the players exhaust their distance cards. Various strategies obviously are involved. For instance, a player may wish to land in the trap 64 nearest the green since he has a 50 percent chance of "holing out" or putting from 5 or 12 feet, as indicated by indicia 72*a* on the card 26. Likewise, there is a 66 percent chance of coming back out onto the fairway with indicia 72*c* and 72*d*, by roll of the die, all of which must be considered for strategy purposes.

After all of the players are on the fairway and the strokes or shots are totalled, the players proceed to lay down a second card in an attempt to reach the green. Again, two of the players, in this case the players One and Two having laid down cards representing the largest number of yards, will be in the trap 64 near the green, while players Three and Four will be on the green. The players One and Two will then use the indicia 72*a* on the hazard card 26 in an attempt to get onto the green and follow the instructions thereon. For example, a roll of a 3 indicates that the player is on the green with a 35 foot putt, while a roll of a 6 indicates that the player has successfully reached the hole directly from the trap. The small superscript numbers 74 adjacent the numbers 3 and 4 (FIG. 4) represents the distance which these player's ball lies from the hole. The players then attempt to putt into the hold by using the putting green 12. As previously described, the players putt from the yardage marker notches 40 adjacent the indicia 42 representative of their position in feet from the hole. Each attempt to putt is counted as a stroke, until all of the players of the game have successfully putted. The total number of strokes for each player is then placed in a horizontal column on the score card adjacent his name and a subsequent hole card is chosen for the next round or hole. The player having the highest score (or the lowest score, depending on the rules) on the previous hole (or for the game, for example) may be permitted to play his distance card last so as to possibly more evenly match the scores. Of course, other schemes of play are contemplated. The game progresses until 9 or 18 holes have been played and the player, as in golf, with the lowest number of shots is declared the winner of the game.

The foregoing detailed description has been given for clearness of understanding only and no unnecessary limitations should be understood therefrom as some modifications will be obvious to those skilled in the art.

I claim:

1. A golf game apparatus, comprising:

a first set of lie cards, at least one for each player of the game, each lie card having indicia thereon representative of a different lie of the ball for the respective players after they all have taken a stroke;

a second set of playing hole cards, each hole card having indicia thereon representative of a particular hole on a golf course, including a plurality of hazards and at least one set of respective positions indicating various relative lies of the players' balls in relation to said hazards, as determined by the cards of said first set of lie cards, after all of the players have taken a stroke;

at least one hazard reference card having indicia thereon dictating the consequences of a player's stroke, as determined by his lie card, landing on a particular position relative to the hazards on the hole card, including indicia instructing a player who has encountered a hazard, as determined by chance, to change his respective lie;

a chance device for use by the players;

a playing board defining a simulated putting green for permitting the players to manually putt when their lie reaches a green on a hole card, said playing board having means defining a putting surface mounted on an upstanding frame for rollingly supporting a playing ball, said putting surface being slanted toward an aperture representative of a golf hole; and a playing ball for rolling on said playing board.

2. The golf game of claim 1 wherein said putting surface is concave in cross section.

3. A golf game apparatus, comprising:

a first set of lie cards, at least one for each player of the game, each lie card having indicia thereon representative of a different lie of the ball for the respective players after they all have taken a stroke;

a second set of playing hole cards, each hole card having indicia thereon representative of a particular hole on a golf course, including a plurality of hazards and at least one set of respective positions indicating various relative lies of the players' balls in relation to said hazards, as determined by the cards of said first set of lie cards, after all of the players have taken a stroke;

at least one hazard reference card having indicia thereon dictating the consequences of a player's stroke, as determined by his lie card, landing on a particular position relative to the hazards on the hole card, including indicia instructing a player who has encountered a hazard, as determined by chance, to change his respective lie;

a chance device for use by the players;

a playing board defining a simulated putting green for permitting the players to manually putt when their lie reaches a green on said hole card, wherein said playing board has means defining a putting surface, including markers thereon indicating putts of various distances, mounted on an upstanding frame for rollingly supporting a playing ball, said putting surface including an aperture therein representative of a golf hole, and a playing ball for rolling on said playing board.

4. A golf game apparatus, comprising:

a first set of lie cards, at least one for each player of the game, each lie card having indicia thereon representative of a different lie of the ball for the respective players after they all have taken a stroke;

a second set of playing hole cards, each hole card having indicia thereon representative of a particular hole on a golf course, including a plurality of hazards and at least one set of respective positions indicating various relative lies of the players' balls in relation to said hazards, as determined by the cards of said first set of lie cards, after all of the players have taken a stroke;

at least one hazard reference card having indicia thereon dictating the consequences of a player's stroke, as determined by his lie card, landing on a particular position relative to the hazards on the hole card, including indicia instructing a player who has encountered a hazard, as determined by chance, to change his respective lie;

a chance device for use by the players;

a playing board defining a simulated putting green for permitting the players to manually putt when their lie reaches a green on said hole card, wherein said playing board has means defining a putting surface mounted on an upstanding frame for rollingly supporting a playing ball, said putting surface including an aperture therein representative of a golf hole; and a playing ball and miss-indicating means to determine the consequence of a player who has missed a putt, by missing said aperture.

5. The golf game of claim 4 wherein the miss indicating means includes indicia representative of the distance from which the player must attempt the next putt.

6. A playing board game apparatus simulating a golf putting green, comprising:

a frame defining a putting surface for rollingly supporting a playing ball and an aperture representative of a golf hole, said putting surface sloping generally downwardly toward the hole and extending therepast to a miss-receiving area, a playing ball for rolling down said putting surface toward the hole, and indicating means in said miss-receiving area to indicate the distance a ball has missed the hole for determining the next putt, wherein said surface includes a plurality of markers and indicia associated with the markers to indicate the distance of a particular putt.

7. The game apparatus of claim 6 wherein said putting surface is concave in cross section.

8. A golf game apparatus, comprising:

a set of distance cards, at least one for each player of the game, each distance having indicia thereon representative of the distance in which a particular player's ball has travelled for a particular stroke;

a set of hole cards having indicia thereon representative of a particular hole on a golf course, including a plurality of hazards and at least one set of respective positions indicating various relative lies of the players' balls in relation to said hazards as determined according to the indicia on their respective distance cards;

at least one hazard reference card having indicia thereon including a plurality of events which, determined by chance, may befall a particular player should his respective lie indicate that he has encountered a particular hazard;

a chance device for use by the players of the game to determine which event on said hazard reference card has befell a player for encountering that particular hazard;

a playing board having means defining a putting surface for rollingly supporting a playing ball and an aperture representative of a golf hole; and a playing ball for rolling on said putting surface to permit the players to putt when their lie reaches a green on one of said hole cards wherein the putting surface includes a plurality of markers and indicia associated with the markers to indicate the distance of a particular putt attempt from the hole.

9. A golf game apparatus, comprising:

a set of distance cards, at least one for each player of the game, each distance having indicia thereon representative of the distance in which a particular player's ball has travelled for a particular stroke;

a set of hole cards having indicia thereon representative of a particular hole on a golf course, including a plurality of hazards and at least one set of respective positions indicating various relative lies of the players' balls in relation to said hazards as determined according to the indicia on their respective distance cards;

at least one hazard reference card having indicia thereon including a plurality of events which, determined by chance, may befall a particular player should his respective lie indicate that he has encountered a particular hazard;

a chance device for use by the players of the game to determine which event on said hazard reference card has befell a player for encountering that particular hazard;

a playing board having means defining a putting surface for rollingly supporting a playing ball and an aperture representative of a golf hole; and a playing ball for rolling on said putting surface to permit the players to putt when their lie reaches a green on one of said hole cards wherein the putting surface is concave in cross section and is inclined downwardly toward said hole.

* * * * *